US005303646A

United States Patent [19]

Melzer et al.

[11] Patent Number: 5,303,646

[45] Date of Patent: Apr. 19, 1994

[54] RELIEF PRINTING METHOD AND APPARATUS FOR ITS IMPLEMENTATION

[75] Inventors: Rainer Melzer; Roland Melzer, both of Schwelm, Fed. Rep. of Germany

[73] Assignee: Melzer Maschinenbau GmbH, Fed. Rep. of Germany

[21] Appl. No.: 7,616

[22] Filed: Jan. 22, 1993

[30] Foreign Application Priority Data

Jan. 23, 1992 [DE] Fed. Rep. of Germany ..... 4201756

[51] Int. Cl.[5] ..... B31F 1/07

[52] U.S. Cl. ..... 101/32; 101/368

[58] Field of Search ..... 101/108, 212, 216, 287, 101/316, 333, 338, 368, 407.1, 474, 475, 297, 327, 32

[56] References Cited

U.S. PATENT DOCUMENTS

| | | | |
|---|---|---|---|
| 2,068,649 | 1/1937 | Anderson | 101/368 |
| 3,245,345 | 4/1966 | Graham | 101/407.1 |
| 3,972,284 | 8/1976 | Bell | 101/368 |

FOREIGN PATENT DOCUMENTS 0329600 5/1976 Austria .

*Primary Examiner*—Edgar S. Burr
*Assistant Examiner*—Ren Yan
*Attorney, Agent, or Firm*—Thomas L. Bohan; Chris A. Caseiro

[57] ABSTRACT

A relief printing technique wherein the material to be printed on is placed between an inked relief and a supporting assembly comprising a dressing web and a second relief reproducing the pattern of the printing relief.

7 Claims, 1 Drawing Sheet

RELIEF PRINTING METHOD AND APPARATUS FOR ITS IMPLEMENTATION

FIELD OF THE INVENTION

The present invention relates to the field of printing techniques and in particular to a novel method of relief or "book" printing. The invention relates also to an apparatus adapted to implement the method.

DESCRIPTION OF THE PRIOR ART

The art of relief printing has been known for centuries. A stereotype plate or block has a relief reproducing the pattern to be printed, and the protruding areas thereof are ink-loaded and pressed against a material to be printed on, e.g. a web of paper whereby the ink is transferred from the relief to the material. During this printing operation, the material web is supported by a somewhat resilient support which frequently is designated a "dressing web"; this designation indicates that the printer has to manipulate or "dress" the support so as to adapt it to the particular pattern to be printed. Such manipulation comprises placing of paper bits or trims beneath the dressing web at appropriate locations to be determined by a trial and error process. The reason necessitating such dressing is that the pattern to be printed exhibits inked areas of different size, and the protruding relief portions usually taper from a normally rigid carrier portion of the stereotype towards the inked areas. In result, the contact pressure is not uniform, and without proper dressing, smaller areas will usually transfer more ink to the paper web than larger areas.

SUMMARY OF THE INVENTION

The inventors have discovered that manipulation of the dressing web can become superfluous if the present invention is applied. In substance, the dressing web (this designation is adhered to despite the fact that no dressing in the sense of the word will be necessary any more) is replaced with a composite support including a resilient web (the "dressing web") plus a duplicate of the stereotype relief of the printing block.

In one embodiment, the duplicate stereotype is identical with the printing or inked stereotype and is placed between the material web to be printed on and the dressing web, both the printing and the supporting reliefs facing towards the dressing web. Means are provided to properly align the two reliefs or to position them "in register".

In a second embodiment, the duplicate stereotype relief mirrors that of the printing stereotype and is placed beneath the dressing web, the two reliefs facing one another and being properly aligned as in the first embodiment.

The attached drawings illustrate schematically the two alternatives of the present invention.

DETAILED DESCRIPTION OF THE PREFERRED EMBODIMENTS

Figure 1:
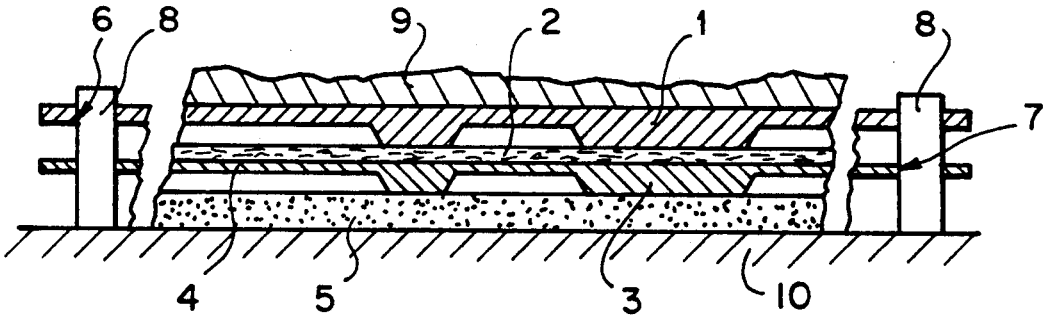
FIG. 1 is a partial section view of an apparatus of the first embodiment.

Referring first to FIG. 1, a printing block 9 carries a stereotype member 1 having a relief in accordance with the pattern to be reproduced or printed on a web of material, for example, a sheet of paper 2. Block 9 with first stereotype member 1 is reciprocable towards and away with respect to a rigid support 10. Support 10 supports a dressing web 5 consisting e.g of rubber of a suitable hardness. A second stereotype member 3 is disposed upon the dressing web 5 with its relief facing towards the dressing web 5. It is to be noted that the position of second stereotype member 3 relative to support 10 is accurately determined by means of posts 8 engaging into respective holes 7 of second stereotype member 3. Similarly, first stereotype member 1 has holes which engage over posts 8 when the printing block 9 approaches support 10. In this manner congruence of the relief patterns of stereotype members 1 and 3 is assured. It will be understood that other means may be provided to effect registration of the two reliefs but such means will not be further discussed as they are readily available to a person skilled in the art of printing.

It is to be noted that the first (printing) stereotype member 1 has a rather rigid carrier of the relief. In contrast thereto, a carrier portion 4 of the second stereotype member 3 is rather resilient such that the individual "islands" of the relief are displaceable relative to one another in the direction of the reciprocating printing block 9 so that they may uniformly distribute the contact pressure towards the underlying dressing web 5.

Figure 2:
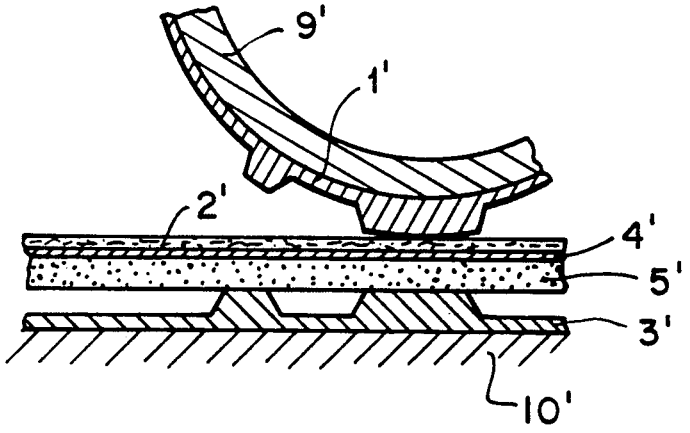
FIG. 2 is a similar view relating to the second embodiment.

Referring to FIG. 2, similar or equivalent members to those of the first embodiment have been marked with the same reference sign plus an index '.

Printing block 9' is drum-shaped and may roll along the dressing web 5'. Of course, the first (printing) stereotype member 1' is adapted to the circumference of printing block 9'. The rigid support 101 supports the second stereotype member 3' with its relief facing the relief of the first stereotype member 1'. It will be seen that the relief of second stereotype member 3' duplicates that of first stereotype member 1' in a mirrored fashion so that the individual "islands" of the reliefs are again congruent provided that members 1' and 3' are in proper alignment or registration; means similar to those illustrated in FIG. 1 may be provided for this purpose. The dressing web 5' is comprised of a rubber web similar to that of FIG. 1 plus a thin, resilient layer 4' which is the equivalent of the carrier 4 in FIG. 1. In this manner, the individual pairs of facing islands will perform their printing action independent of adjacent other pairs of islands.

We claim:

1. A relief printing method wherein a first stereotype block having an ink-carrying relief pattern is pressed against a material to be printed on, the method comprising the steps of:

providing a rigid support, providing a resilient dressing web, providing a first stereotype block having a relief pattern thereon, providing a second stereotype block repeating the relief pattern of said first stereotype block, combining said dressing web and said second stereotype block such that said relief pattern of said second stereotype block faces said dressing web, and placing said combined dressing web and second stereotype block on said rigid support such that the relief patterns of said first and second stereotype blocks are in register with the relief patterns of both of said first and second stereotype blocks facing said dressing web.

2. The relief printing method of claim 1 wherein the reliefs of said first and second stereotype blocks are identical and both face toward said rigid support.

3. The printing method of claim 1 wherein the reliefs of said first and second stereotype blocks mirror each other and face one another.

4. An apparatus for relief printing comprising:

a rigid support, a printing block displaceable towards and away from said rigid support, a first stereotype block mounted on said printing block and having an ink-carrying relief pattern facing said rigid support, a resilient dressing web forming a combination with a second stereotype block having a relief pattern repeating the relief pattern of said first stereotype block, the relief pattern of said second stereotype block facing said dressing web, and said combination being placed on said rigid support, means for positioning said first and second stereotype blocks in register with one another with the relief patterns of said first and second stereotype blocks being in register and both facing said dressing web when said printing block is displaced towards said rigid support so as to transfer printing ink to material supported by said combination.

5. The apparatus of claim 4 wherein said resilient dressing web is disposed between said second stereotype block and said rigid support, wherein the relief of said first stereotype block is identical to the relief of said second stereotype block, and the reliefs of said first and second stereotype blocks both face said rigid support.

6. The apparatus of claim 5 wherein said first stereotype block includes a rigid relief carrier and wherein said second stereotype block includes a resilient relief carrier.

7. The apparatus of claim 4 wherein the relief of said first stereotype block mirrors the relief of said second stereotype block.

* * * * *